United States Patent [19]

Ando et al.

[11] 4,158,351

[45] Jun. 19, 1979

[54] FLOW CONTROL VALVE FOR AN EXHAUST GAS RECIRCULATION APPARATUS OF AN EXHAUST GAS PRESSURE CONTROL TYPE

[75] Inventors: Masahisa Ando, Aichi; Keigo Kato, Toyota; Masami Yamazaki, Toyokawa; Yosio Kuroiwa, Toyota, all of Japan

[73] Assignee: Toyota Jidosha Kogyo Kabushiki Kaisha, Toyota, Japan

[21] Appl. No.: 774,472

[22] Filed: Mar. 4, 1977

[30] Foreign Application Priority Data

Dec. 14, 1976 [JP] Japan ..... 51/149341

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,834,363 | 9/1974 | Goto et al. | 123/119 A |
| 3,928,966 | 12/1975 | Goto et al. | 123/119 A |
| 3,930,475 | 1/1976 | Lewis et al. | 123/119 A |
| 3,974,807 | 8/1976 | Nohira et al. | 123/119 A |
| 3,981,283 | 9/1976 | Kaufmam | 123/119 A |
| 4,052,969 | 10/1977 | Ando et al. | 123/119 A |
| 4,056,084 | 11/1977 | Baumgartner | 123/119 A |

*Primary Examiner*—Charles J. Myhre
*Assistant Examiner*—Craig R. Feinberg
*Attorney, Agent, or Firm*—Stevens, Davis, Miller & Mosher

[57] ABSTRACT

A flow control valve for an exhaust gas recirculation apparatus is provided with an exhaust gas pressure control means for maintaining a predetermined constant pressure of exhaust gas to be recirculated. The flow control valve is adpated to control an amount of the exahust gas to be directed to the pressure controlling means, for performing an ideal EGR operation. A detailed design of the flow control valve is provided for solving the problems which may occur during the actual use of the flow control valve.

3 Claims, 5 Drawing Figures

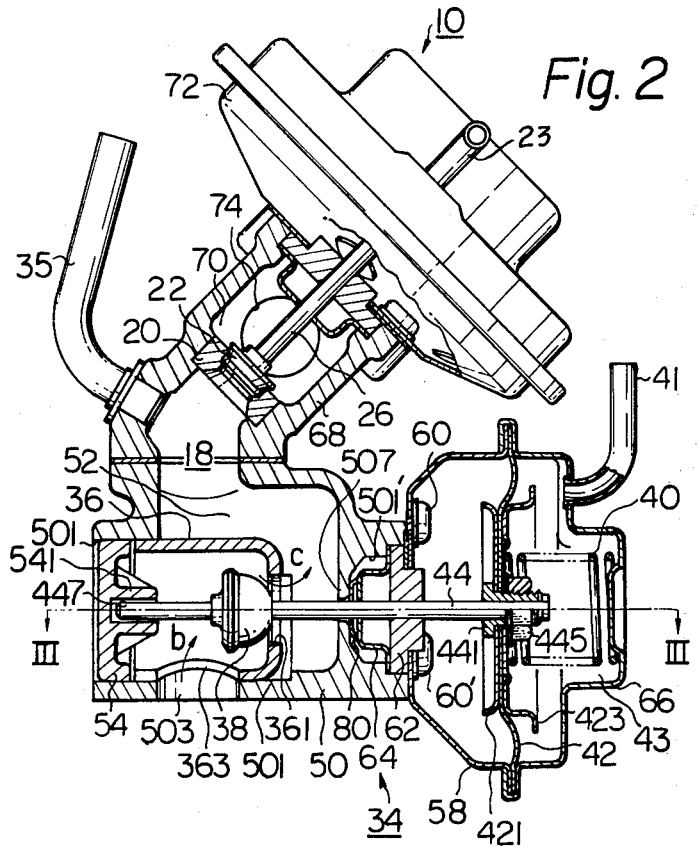
Fig. 2
Fig. 4
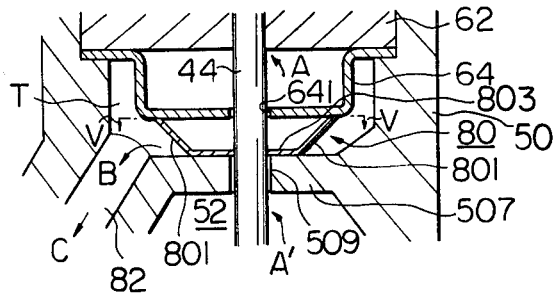
Fig. 5
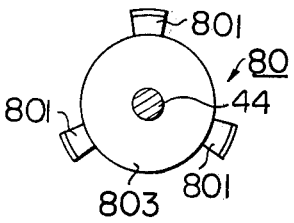

FLOW CONTROL VALVE FOR AN EXHAUST GAS RECIRCULATION APPARATUS OF AN EXHAUST GAS PRESSURE CONTROL TYPE

DESCRIPTION OF THE INVENTION

The present invention relates to a flow control valve utilized for an exhaust gas recirculation apparatus of a so-called exhaust gas pressure control type.

An exhaust gas recirculation apparatus of the so-called exhaust gas pressure control type which includes, in combination, a pressure control valve and a vacuum control valve for maintaining a predetermined constant pressure of the exhaust gas to be recirculated, has already been proposed. Recently used in this type of apparatus is a flow control valve adapted for controlling the amount of exhaust gas directed to the pressure control valve in accordance with the engine load, in order to carry out an ideal EGR operation.

An object of the present invention is to provide a detailed design of the above-mentioned flow control valve which is capable of solving some problems encountered during the actual use of the valve.

Other objects and advantages of the invention will become apparent from the following detailed description, with reference being made to the accompanying drawings.

FIG. 1 schematically illustrates an exhaust gas recirculation apparatus of an exhaust gas pressure control type, to which a flow control valve according to the present invention is applied;

FIG. 2 is a detailed sectional view of the flow control valve according to the invention;

FIG. 4 is an enlarged view of a portion of FIG. 2, and;

FIG. 5 is a view taken along the V—V line of FIG. 4.

Figure 1:
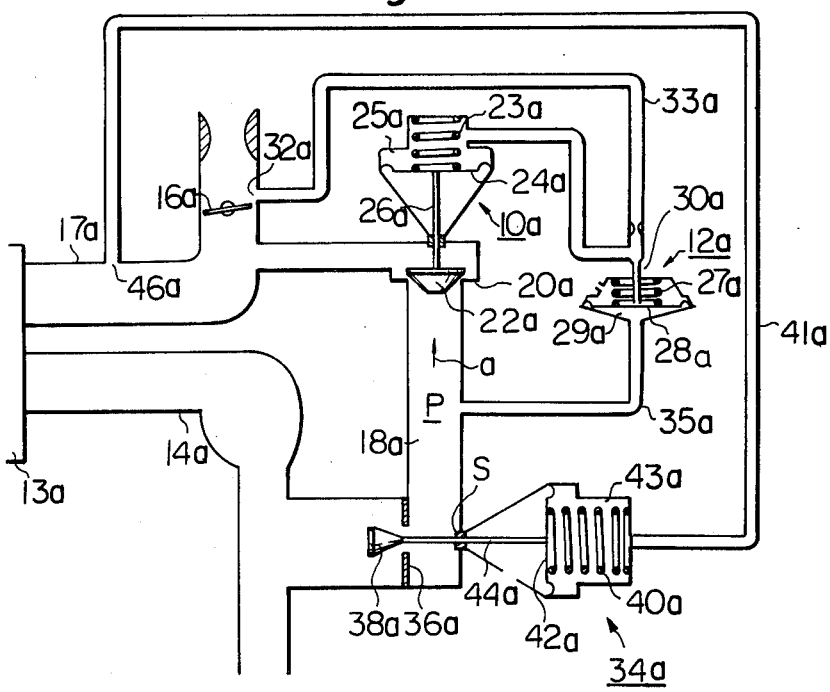

In FIG. 1, the exhaust gas recirculation apparatus of the so-called exhaust gas pressure control type, to which the present invention is applied, comprises an exhaust gas pressure control means, including, in combination, a pressure control valve 10*a*, a vacuum control valve 12*a*, and a flow control valve 34*a*. The pressure control valve 10*a* has a valve seat 20*a* located on an exhaust gas recirculation passageway (EGR passageway) 18*a* connecting an exhaust manifold 14*a* of the engine 13*a* to an intake manifold 17*a* of the engine. A valve member 22*a* is connected, via a rod 26*a*, to a diaphragm 24*a* which is urgd by a spring 23*a* so that the valve member 22*a* is moved toward the valve seat 20*a*. A vacuum signal chamber 25*a* formed above the diaphragm 24*a* is connected, via a vacuum signal tube 33*a*, to a vaccum port 32*a* (so-called EGR port) which is located slightly above a throttle valve 16*a* when the throttle valve 16*a* is in its idle position. The distance between the valve member 22*a* and the valve seat 20*a* can be controlled in accordance with the level of the vacuum signal, in the vacuum signal chamber 25*a*, in other words, the vacuum force applied to the disphragm 24*a*. Therefore, the pressure P of the exhaust gas in the EGR passageway 18*a* at a position located between the pressure control valve 10*a* and the flow control valve 34*a* is controlled in accordance with the vacuum level in the vacuum signal chamber 25*a*.

The vacuum control valve 12*a* has a diaphragm 28*a* forming an exhaust gas pressure chamber 29*a* which is connected, via the tube 35*a*, to the EGR passageway 18*a* at a position located between the pressure control valve 10*a* and the flow control valve 34*a*. An air introducing port 30*a* connected to the vacuum tube 33*a* is positioned opposite the diaphragm 28*a* which is urged downwardly by a spring 27*a*. The diaphragm 28*a* of the vacuum control valve 12*a* operates to open or close the introducing port 30*a* in accordance with the pressure P. Thus an amount of air is selectively introduced into the vacuum tube 33*a*. Also, the vacuum level in the vacuum signal chamber 25*a* of the pressure control valve 10*a* is controlled so that the pressure of the exhaust gas P is kept to a predetermined constant value.

The flow control valve 34*a*, for controlling the amount of exhaust gas directed to the pressure control valve 10*a* in accordance with the load of the engine, as shown by an arrow a, has a valve seat 36*a* located on the EGR passageway 18*a*. A valve member 38*a* located opposite the valve seat 36*a* is connected, via a slidably supported rod 44*a* to a diaphragm 42*a* which is urged by a spring 40*a* for moving the valve member 38*a* away from the valve seat 36*a*. A vacuum signal chamber 43*a*, formed on one side of the diaphragm 42*a* is connected, via a vacuum tube 41*a*, to a vacuum port 46*a* formed in the intake manifold 17*a*. Thus, the amount of exhaust gas passed through the flow control valve 34*a* can be controlled in accordance with the vacuum force applied to the diaphragm 42*a* which force corresponds to the degree of opening of the throttle valve, in other words, the load of the engine. This particular operation of the flow control valve 34*a*, as is well known to those skilled in this art, allows an ideal EGR operation to be performed. Problems as those described hereinafter are often encountered during the actual use of the flow control valve 34*a*.

(1) The pressure P of the exhaust gas, which exists between the flow control valve 34*a* and the pressure control valve 10*a* in the EGR passageway, is controlled to a predetermined constant positive value, due to the operation of the vacuum control valve 12*a*. Therefore, the exhaust gas is apt to reach the sliding portion S of the rod 44*a*, which action prevents a smooth slide movement of the rod 44*a*, thereby causing the so-called "sticking of the valve", due to dust contained in the exhaust gas.

(2) During the assembling of the flow control valve 34*a*, it is difficult to obtain such a valve wherein a predetermined flow amount of the exhaust gas is maintained under a predetermined constant vacuum force applied to the diaphragm of the valve. This causes an increase in the manufacturing cost of the valve.

(3) The use of valve member 38*a* of a relatively large dimension is necessary to control the amount of exhaust gas to be recirculated. Therefore, the valve 38*a* secured to the free end of the rod 44*a* is apt to be shaken during the slide movement of the rod 44*a*, which causes the slide portion S to wear out when used for a short time, as well as the destruction of the flow control valve 34*a* itself.

In FIGS. 2 through 5, a detailed design of the flow control valve of the present invention, capable of solving the above-mentioned problems (1) through (3), is shown. In FIGS. 2 through 5, the same reference numbers without the lower case letter "a" are used for parts which perform the same functions as those parts described in FIG. 1.

In the embodiment shown by FIGS. 2 through 5, a flow control valve 34 is located near the flow control valve 10 to together form a one-piece assembly. The vacuum control valve 12*a* in FIG. 1 has been omitted from FIGS. 2 through 6.

Flow control valve 34 has a body 50 forming a chamber 52 therein, which chamber 52 forms a part of the EGR passageway 18. The body 50 has a cylindrical hole 501, to which a valve seat 36 in the shape of a cup is press-fitted. An exhaust gas inlet 363 is formed on the cylindrical wall of the cup-shaped valve seat 36. The inlet 363 is aligned with an exhaust gas inlet 503 formed in the body 50. The inlet 503 is connected, via pipe means (not shown) to the exhaust manifold 14*a* in FIG. 1. Thus, the exhaust gas is allowed to be directed to the valve seat 36 via the inlets 503 and 363, as shown by an arrow b in FIG. 2. The cup-shaped valve seat 36 has a valve port 361.

A valve member 38 is arranged to face the valve port 361, thereby permitting the exhaust gas to pass through the port 361, as shown by an arrow C, when the valve member 38 is detached from the valve port 361.

Opposite to the cylindrical hole 501, a cylindrical recess 501' is formed in the body 50 to form a partition 507 between the chamber 52 and the recess 501'. A bearing plate 62 together with dust plate 64 are fitted to the recess 501' and fixedly secured to the body 50 by means of a diaphragm case 58 and bolts 60.

A valve rod 44, which is axially-slidably supported by the bearing member 62, freely passes through the dust plate 64 and the partition 507, as is shown in FIG. 4. The dust plate 64 operates to prevent a large amount of exhaust gas containing dust from being directed to the bearing plate 62. One end of the valve rod 44 is fixedly secured to the valve member 38. A diaphragm 42 is attached to the other end of the rod 44 as is fully described later.

A closure plate 54 is press-fitted to the cylindrical hole 501. The plate 54 has an inner boss portion 541, to which a free end of the rod 44 is loosely fitted, in order to prevent the shaking of the rod 44 during the slide movement thereof.

The peripheral portion of the diaphragm 42 is held between the diaphragm case 58 and another diaphragm case 66 fixed to the case 58. A sleeve member 441 is fixed onto the end of the rod 44. The sleeve 441 is inserted into the diaphragm 42 sandwiched between plates 421 and 423, and a nut 445 is screwed to the sleeve 441. Thus, the diaphragm 42 is fixedly attached to the rod 44. A spring 40, urges the diaphragm 42, toward the body 50. A vacuum tube 41, which is connected to the vacuum port 46*a*, in FIG. 1, communicates with a vacuum chamber 43 formed on one side of the diaphragm 42.

The pressure control valve 34 has, as shown in FIG. 2, a body 68 which is integrally formed to the body 50 of the flow control valve 34 according to the invention. The body 60 has a chamber 70 communicating with the chamber 52 in the body 50 and forming a part of the EGR passageway 18. A valve seat 20 is formed in the body 68. A valve member 22 facing the valve seat 20 is connected, via a rod 26, to a diaphragm in FIG. 1, this is shown by the number 24*a*, in a diaphragm case 72. A vacuum force is applied to the diaphragm (not shown) due to the vacuum signal level transmitted from the engine. Thus, the position of the valve member 22 with respect to the valve seat 20 is controlled to maintain a predetermined constant positive pressure of the exhaust gas in the EGR passageway 18, as is already described with reference to FIG. 1.

A conduit 74 communicating with the chamber 70 is formed in the bodies 50 and 68, which conduit 74 forms a part of the EGR passageway 18 and is connected to the intake manifold shown by reference numeral 17*a* in FIG. 1.

According to the present invention, a seal plate 80 is located between the dust plate 64 and the partition 507. The seal plate 80, made of a very thin metallic material, has a ring portion 803 (FIGS. 4 and 5) which is slidably inserted to the rod 44 and rested on the surface of the partition 507. The plate 80 sealingly engages the rod 44, so that the dust directed to a clearance 509 (formed between the rod 44 and the partition 507) from the exhaust gas chamber 52 does not reach the bearing plate 62 via a clearance 641 (formed between the dust plate 64 and the rod 44).

On the periphery of the ring portion 803, leg portions 801 are integrally formed. The outer end of each leg portion 801 abuts against the dust plate 64 to slightly displace the leg portions 801 toward the partition 507. Thus, the ring portion 803 is contacted with the partition 507. The body 50 has an exhaust gas by-pass conduit 82 which is opened to a space T. The space T is formed below the dust plate 64 as shown by FIG. 4. The conduit 82 is opened to the exhaust gas conduit 74 (FIG. 3) connected to an intake manifold of the engine (which is shown by the reference numeral 17*a* in FIG. 1). The above-mentioned flow control valve can solve the aforesaid problems (1) through (3) as will be described hereinafter.

(1) As is clear from FIG. 4, the seal plate 80, which is sealingly engaged with the valve rod 44, contacts the partition 507 under a force due to the elastic deformations of the leg portions 801 engaging with the dust plate 64. Therefore, the exhaust gas leaked to the clearance 509, as shown by an arrow A' under a positive pressure of the recirculated exhaust gas does not reach the bearing plate 62 via the clearance 641, as shown by an arrow A'. Therefore, the clogging of the bearing plate 62, due to dust contained in the leaked exhaust gas, is effectively prevented. Accordingly, a smooth slide movement of the valve rod 44 with respect to the slide plate 62 is always performed. Therefore, the so-called "sticking of the valve" does not occur. The leaked exhaust gas is directed to the space T via a clearance formed between the partition 507 and the seal plate 80, as shown by an arrow B, and is introduced into the conduit 74 (FIG. 3) via the exhaust gas by-pass conduit 82, as shown by an arrow C. This is because the conduit 74 (FIG. 3) is under negative pressure due to the fact that the conduit 74 is connected to the intake manifold of the engine, which is shown by the numeral 17*a* in FIG. 1. This leaked exhaust gas does not cause any bad effects on the EGR operation, because the amount of the leaked exhaust gas is relatively small.

Figure 3:
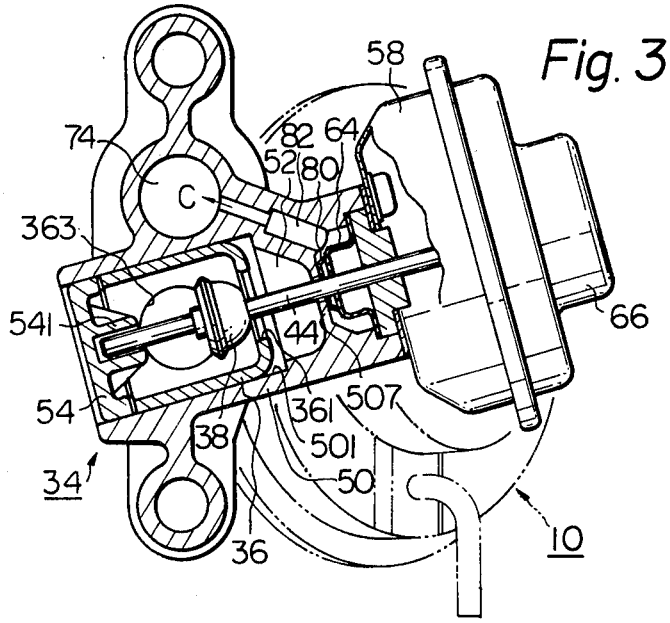
FIG. 3 is a view taken along the III—III line of FIG. 2.

(2) During assembling of the flow control valve, the cup-shaped valve seat 36 is press fitted to the cylindrical hole 501 (FIGS. 2 and 3). The valve seat 36 is gradually press fitted to the cylindrical hole 501, while a predetermined vacuum force is being applied to the diaphragm 42, until a constant distance is left between the valve member 38 and the valve port 361. Thus, the flow control valve 44 of a constant flow characteristic can be easily assembled, thereby decreasing the cost of manufacturing the valve.

(3) In FIG. 2, the boss portion 541 of the closure plate 54 prevents the shaking of the free end 447' of the valve rod 44 during the axial slide movement of the rod 44.

Therefore, wearing of the bearing plate 62 after a short time of use does not occur.

What is claimed is:

1. In an exhaust gas recirculation system for an internal combustion engine which includes an exhaust gas recirculation passageway connecting the exhaust system of the engine with the intake system of the engine, pressure control means for controlling the pressure of exhaust gas to be recirculated through said passageway, the improvement that comprises:

a body having an exhaust gas chamber which forms a part of said exhaust gas recirculation passageway, said body having a cylindrical recess on one side thereof to form a partition between the chamber and the recess, a valve seat located in said chamber;

a valve member facing said valve seat;

a vacuum actuator means mounted on said one side of said body and having a spring-urged diaphragm, to which diaphragm a vacuum force in the engine intake system is applied;

a bearing member secured to said cylindrical recess;

a valve rod extending transversely to said bearing member and said partition, said rod freely passing through the partition and slidably passing through the bearing member, one end of said rod being attached to said valve member, and the other end of said rod being attached to said diaphragm; and plate means through which the valve rod passes, said plate means having one end fixed to the bearing member, said plate means on the other end thereof being resiliently pressed to said partition, whereby exhaust gas leaked to a clearance between said rod and said partition is prevented from reaching said bearing member, and said leaked gas is introduced, under a suctional force formed in the intake system, into an exhaust gas by-pass conduit formed in said body, which conduit being connected to said exhaust gas recirculation passageway located near said intake system.

2. In an exhaust gas recirculation system for an internal combustion engine which includes an exhaust gas recirculation passageway connecting the exhaust system of the engine with the intake system of the engine, pressure control means for controlling the pressure of exhaust gas to be recirculated through said passageway, the improvement that comprises:

a body having an exhaust gas chamber which forms a part of said exhaust gas recirculation passageway, said body having a cylindrical recess on one side thereof to form a partition between the chamber and the recess, a valve seat located in said chamber;

a valve member facing said valve seat;

a vacuum actuator means mounted on said one side of said body and having a spring-urged diaphragm, to which diaphragm a vacuum force in the engine intake system is applied;

a bearing member secured to said cylindrical recess;

a valve rod extending transversely to said bearing member and said partition, said rod freely passing through the partition and slidably passing through the bearing member, one end of said rod being attached to said valve member, and the other end of said rod being attached to said diaphragm; and plate means through which the valve rod passes, said plate means comprising a dust plate which is on one side thereof fixed to said bearing member, wherein said rod passes freely through said dust plate; and a seal member made of a very thin metallic material which has a ring portion slidably and sealingly fitted to said rod so that said portion is rested on said partition, and which has leg portions formed integrally to said ring portion at the periphery thereof, which leg portions being rested on the other side of said dust plate so that said leg portions are elastically deformed so that the ring portion contacts with said partition, whereby exhaust gas leaked to a clearance between said rod and said partition is prevented from reaching said bearing member, and said leaked gas is introduced, under a suctional force formed in the intake system, into an exhaust gas by-pass conduit formed in said body, which conduit being connected to said exhaust gas recirculation passageway located near said intake system.

3. In an exhaust gas recirculation system for an internal combustion engine which includes an exhaust gas recirculation passageway connecting the exhaust system of the engine with the intake system of the engine, pressure control means for controlling the pressure of exhaust gas to be recirculated through said passageway, the improvement that comprises:

a body having an exhaust gas chamber which forms a part of said exhaust gas recirculation passageway, said body having a cylindrical hole formed on one side of said body for communicating said hole with said chamber, said hole having one end open to the exterior of the body;

means closing said open end of said hole;

a valve member arranged in said chamber;

a valve rod slidably supported onto said body and connected, on one end thereof, to said valve member;

a vacuum actuator mounted on said body located opposite to said one open end of the cylindrical hole and having a spring-urged diaphragm connected to said other end of said rod, and;

a tubular-shaped valve seat press-fitted to said cylindrical hole from the one open end thereof, said valve seat having on one end thereof a valve port coacting with said valve member, said press-fitting being such that a constant distance is obtained between said valve member and said valve seat under a predetermined constant vacuum force applied to said spring-urged diaphragm.

* * * * *